US006098216A

United States Patent [19]

Williamson et al.

[11] Patent Number: 6,098,216

[45] Date of Patent: Aug. 8, 2000

[54] CONVERTIBLE PATIENT TRANSPORT APPARATUS AND METHOD OF TRANSPORTING A PATIENT

[75] Inventors: Theodore A. Williamson, 648 Ideal Way, Charlotte, N.C. 28203; Mark B. Behrens, Charlotte, N.C.

[73] Assignee: Theodore A. Williamson, Charlotte, N.C.

[21] Appl. No.: 09/181,097

[22] Filed: Oct. 28, 1998

[51] Int. Cl.[7] ..... A61G 7/10

[52] U.S. Cl. ..... 5/86.1; 5/83.1; 5/85.1

[58] Field of Search ..... 5/81.1 R, 83.1, 5/86.1, 85.1

[56] References Cited

U.S. PATENT DOCUMENTS

| | | | |
|---|---|---|---|
| 528,475 | 10/1894 | Goulding . | |
| 545,741 | 9/1895 | Shutters . | |
| 680,814 | 8/1901 | Smith . | |
| 775,520 | 11/1904 | Grigler . | |
| 904,587 | 11/1908 | Wible . | |
| 1,227,301 | 5/1917 | Ogden . | |
| 1,263,611 | 4/1918 | Scroggin . | |
| 1,301,284 | 4/1919 | Ledan . | |
| 1,451,437 | 4/1923 | Bernier . | |
| 1,588,573 | 6/1926 | Edmiston . | |
| 1,968,477 | 7/1934 | Cole . | |
| 2,035,116 | 3/1936 | Elmick . | |
| 2,100,663 | 11/1937 | Maddox . | |
| 2,283,511 | 5/1942 | Sellers et al. . | |
| 2,603,851 | 7/1952 | Hawkins . | |
| 2,629,108 | 2/1953 | Wickey . | |
| 2,659,092 | 11/1953 | Conyers | 5/86.1 |
| 3,334,360 | 8/1967 | Hoxeng et al. . | |
| 3,373,451 | 3/1968 | Schmidt . | |
| 3,383,717 | 5/1968 | Underwood . | |
| 3,701,170 | 10/1972 | Bond . | |
| 5,068,931 | 12/1991 | Smith . | |
| 5,161,267 | 11/1992 | Smith | 5/88.1 |
| 5,235,712 | 8/1993 | Smith . | |
| 5,315,723 | 5/1994 | Smith | 5/85.1 |
| 5,544,371 | 8/1996 | Fuller | 5/85.1 |
| 5,570,483 | 11/1996 | Williamson . | |

FOREIGN PATENT DOCUMENTS

| | | |
|---|---|---|
| 4795 | 2/1914 | United Kingdom . |
| 850516 | 10/1960 | United Kingdom . |

*Primary Examiner*—Michael F. Trettel
*Assistant Examiner*—James M Hewitt
*Attorney, Agent, or Firm*—Adams Law Firm, P.A.

[57] ABSTRACT

A convertible patient transport apparatus includes a frame assembly adapted for supporting a patient. A plurality of bent pivot legs are attached to the frame assembly and mounted on respective wheels for rolling movement of the transport apparatus over a supporting surface. Each of the pivot legs includes a vertical upper portion, an intermediate portion formed at an angle to the upper portion, and a vertical lower portion formed with the intermediate portion. An actuator pivots the legs between an open position, wherein the distance between the lower portions of laterally adjacent legs is increased, and a closed position, wherein the distance between the lower portions of laterally adjacent legs is reduced. In the open position, the width of the transport apparatus is expanded to move the frame assembly over a bed of the patient. In the closed position, the width of the transport apparatus is narrowed.

20 Claims, 16 Drawing Sheets

CONVERTIBLE PATIENT TRANSPORT APPARATUS AND METHOD OF TRANSPORTING A PATIENT

TECHNICAL FIELD AND BACKGROUND OF THE INVENTION

This invention relates to a convertible patient transport apparatus and method of transporting a patient. The invention is especially applicable for use in the health care industry to reduce the incidence of on-the-job injury associated with manually lifting, handling and transferring patients. Injuries to the back and shoulder are most common.

Standard programs for health care injury prevention focus on body mechanics and back care, and the proper lifting techniques to employ when handling a patient. Notwithstanding this, injuries result even when proper body mechanics and lifting techniques are used. Lifting a patient is not simply overcoming a heavy weight. The patient's physical condition, size, shape, deformities, physical impairments, and weight are all factors impacting the manner in which a transfer is made. Some patients are combative and uncooperative. Patients can also be unpredictable—suddenly resisting movement and throwing caregivers off balance during a lift or transfer. Optimum posture is often difficult to maintain making the proper lifting technique impractical to follow.

Although mechanical and electromechanical lifting devices have been available for years, statistics showing physical overexertion from lifting and transferring bedridden patients remain unacceptable. Some caregivers are reluctant to use such devices because of their many drawbacks and limitations. Among the disadvantages are the excessive time required to perform the lift and the instability of the patient in the device during the lift. Such devices can also aggravate sensitive skin, and typically place the patient in embarrassing positions when lifted. Moreover, these devices create storage problems, are difficult to maneuver, and generally cannot move sufficiently close to the patient's bed to effect a safe and proper transfer.

Many of the above problems were first addressed by the applicant in its prior issued patent, U.S. Pat. No. 5,570,483, and were further addressed in its subsequent application, U.S. Ser. No. 09/054,728, filed on Apr. 3, 1998. The complete disclosures of this patent and pending application are incorporated herein by reference.

The present invention has features and advantages beyond those described in the '483 Patent and pending application. The invention converts between an expanded condition in order to move directly over the bed of the patient to mechanically lift and remove the patient from the bed, and a narrowed condition in order to effectively maneuver within the patient's room and through doorways and hallways. The invention utilizes bent leg technology to adjust the width of the apparatus without impacting its overall load supporting capacity.

SUMMARY OF THE INVENTION

Therefore, it is an object of the invention to provide a patient lifting and transport apparatus which allows transfer of a patient from the bed to a remote location away from the bed without any manual lifting or handling.

It is another object of the invention to provide a patient transport apparatus which converts between an open expanded condition for straddling the bed of the patient and a narrowed condition for maneuvering within the patient's room and through doorways and hallways.

It is another object of the invention to provide a patient transport apparatus which weighs the patient when lifted.

It is another object of the invention to provide a patient transport apparatus which includes vertically disposed support arms for carrying medical equipment, such as IV pumps.

It is another object of the invention to provide a patient transport apparatus which can be conveniently operated by a single caregiver.

It is another object of the invention to provide a patient transport apparatus which will substantially reduce the incidence of on-the-job injury in the health care industry.

It is another object of the invention to provide a patient transport apparatus which is completely self-contained.

It is another object of the invention to provide a patient transport apparatus which can be moved directly over the bed of the patient.

It is another object of the invention to provide a patient transport apparatus which automatically indicates to the caregiver whether the apparatus is in the proper condition for patient transport.

It is another object of the invention to provide a patient transport apparatus which lifts and lowers the patient safely and evenly.

It is another object of the invention to provide a method of transferring a patient between the bed and a remote location away from the bed without requiring manual lifting or handling.

These and other objects of the present invention are achieved in the preferred embodiments disclosed below by providing a convertible patient transport apparatus. The apparatus includes a frame assembly adapted for supporting a patient. A plurality of bent pivot legs are attached to the frame assembly and mounted on respective wheels for rolling movement of the transport apparatus over a supporting surface. Each of the pivot legs includes a vertical upper portion, an intermediate portion formed at an angle to the upper portion, and a vertical lower portion formed with the intermediate portion. Actuating means pivots the legs between an open position, wherein the distance between the lower portions of laterally adjacent legs is increased, and a closed position, wherein the distance between the lower portions of laterally adjacent legs is reduced. In the open position, the width of the transport apparatus is expanded to move the frame assembly over a bed of the patient. In the closed position, the width of the transport apparatus is narrowed.

According to one preferred embodiment of the invention, the lower vertical portion of each leg extends along an axis offset from and parallel to the upper vertical portion.

According to another preferred embodiment of the invention, the frame assembly includes an upper frame structure attached to the pivot legs.

According to yet another preferred embodiment of the invention, a vertically disposed equipment support bar depends from the upper frame structure for holding medical equipment.

According to yet another preferred embodiment of the invention, the frame assembly includes a lower frame structure attached to the pivot legs and vertically spaced below the upper frame structure.

According to yet another preferred embodiment of the invention, an inverted U-brace is connected to the lower frame structure for laterally supporting the frame assembly.

According to yet another preferred embodiment of the invention, a hoist frame is suspended from the upper frame structure, and is adapted for lifting and lowering the patient in a generally supine position.

According to yet another preferred embodiment of the invention, the hoist frame includes spaced-apart lateral hoist bars located, respectively, near a foot end and a head end of the hoist frame.

According to yet another preferred embodiment of the invention, a fabric hammock is detachably secured to a bottom perimeter of the hoist frame.

According to yet another preferred embodiment of the invention, lifting means are provided for lifting and lowering the hoist frame relative to the frame assembly.

According to yet another preferred embodiment of the invention, the lifting means includes a plurality of lift cables extending downwardly from the upper frame structure to the patient hoist frame.

According to yet another preferred embodiment of the invention, the upper frame structure includes a mounting deck. The lifting means further includes a drive roller assembly mounted on the deck and attached to the lift cables.

According to yet another preferred embodiment of the invention, a gear motor is connected to the drive roller assembly and is mounted on the deck for rotating the drive roller assembly.

According to yet another preferred embodiment of the invention, a vertically disposed guide pulley is rotatably mounted on the mounting deck a spaced-apart distance from the drive roller assembly and above one of the hoist bars for guiding at least one of the lift cables from the drive roller assembly across the deck and downwardly towards the patient hoist frame.

According to yet another preferred embodiment of the invention, the actuating means includes an interconnected linkage assembly operatively connected to respective top ends of the bent pivot legs for inducing simultaneous pivoting movement of the legs between the open and closed positions.

According to yet another preferred embodiment of the invention, the linkage assembly includes an extension bar attached to each of the bent pivot legs.

According to yet another preferred embodiment of the invention, the linkage assembly includes first and second longitudinal side bars extending along respective opposing sides of the frame assembly and interconnecting the extension bars of longitudinally adjacent pivot legs.

According to yet another preferred embodiment of the invention, the linkage assembly includes first and second control bars pivotably connected to respective extension bars of two laterally adjacent legs. The control bars have opposite adjoining ends pivotably connected together in a central area of the frame assembly.

According to yet another preferred embodiment of the invention, the actuating means further includes a linear actuator connected to the adjoining ends of the first and second control bars. Upon extension and retraction of the actuator, the control bars cooperate to move each of the interconnected extension bars and side bars, thereby inducing simultaneous pivoting movement of each of the bent legs between the open position and the closed position.

According to yet another preferred embodiment of the invention, a hand-held remote control is operatively connected to the linear actuator for controlling movement of the legs between the open and closed positions.

According to yet another preferred embodiment of the invention, the hand-held remote control controls movement of the cables for lifting and lowering the patient.

According to yet another preferred embodiment of the invention, a call button is provided for being activated by the patient to summon the assistance of a caregiver.

A further aspect of the invention comprises a method of transporting a patient from a bed to a remote location away from the bed. The method includes the steps of pivoting a plurality of bent legs of a patient transport apparatus to an open position. In the open position, the width of the transport apparatus is expanded to move a frame assembly of the transport apparatus over the bed of the patient. The patient is then secured to a hoist frame suspended from an upper frame structure of the frame assembly. The hoist frame is then lifted to remove the patient from the bed. With the patient supported above the bed, the transport apparatus is moved away from the bed. The bent legs are then pivoted from the open position to a closed position wherein the width of the transport apparatus is narrowed for movement of the transport apparatus to the remote location.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
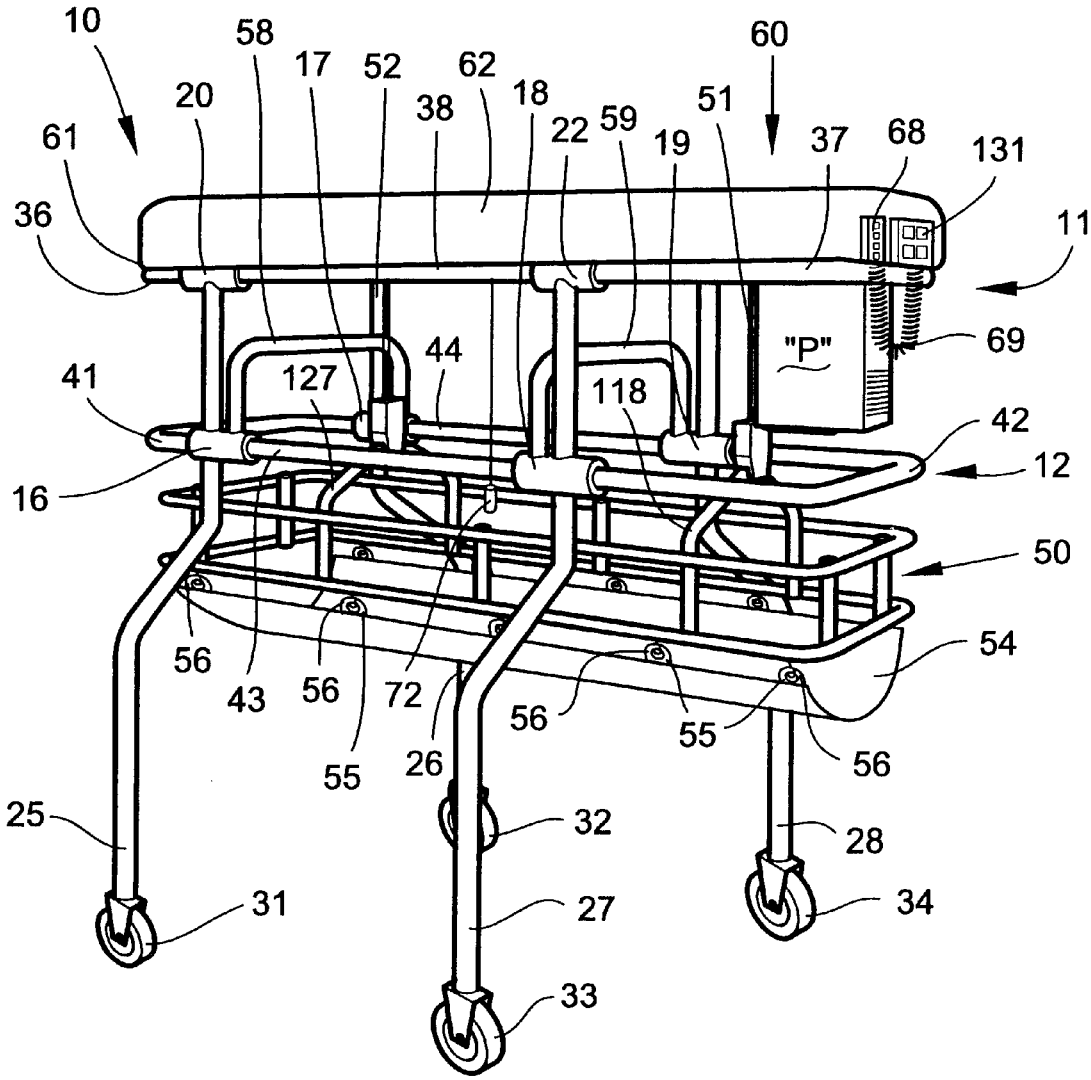
FIG. 1 is a perspective view of the patient transport apparatus according to one preferred embodiment of the invention.

Referring now specifically to the drawings, a convertible patient transport apparatus according to the present invention is illustrated in FIG. 1 and shown generally at reference numeral 10. The apparatus 10 is applicable for use in the health care industry for lifting and transporting a patient from the bed to a remote location away from the bed. The apparatus 10 is further applicable for lifting the patient upwardly from the ground. The apparatus 10 converts between an expanded condition (See FIG. 3) for being positioned directly over the bed of the patient, and a narrowed condition (See FIG. 4) for maneuvering within the patient's room and through doorways and hallways. No manual lifting of the patient is necessary to effect a transfer.

Referring to FIGS. 1–4, the transport apparatus 10 includes a rigid frame assembly formed of vertically spaced upper and lower frame structures 11 and 12. The frame structures 11 and 12 are connected by hollow collars 16–23 to a plurality of bent pivot legs 25, 26, 27, and 28 mounted on respective wheels 31, 32, 33, and 34. The upper frame structure 11 is formed of horizontally disposed, generally U-shaped end sections 36 and 37 and center section members 38 and 39 connected to collars 16–19. The lower frame structure is formed of identical U-shaped end sections 41 and 42 and center section members 43 and 44 connected to collars 20–23. The pivot legs 25–28 pass vertically through center openings formed in vertically aligned pairs of collars 16–23. The collars 16–23 are attached using any suitable means that does not interfere with pivoting movement of the legs.

Figure 2:
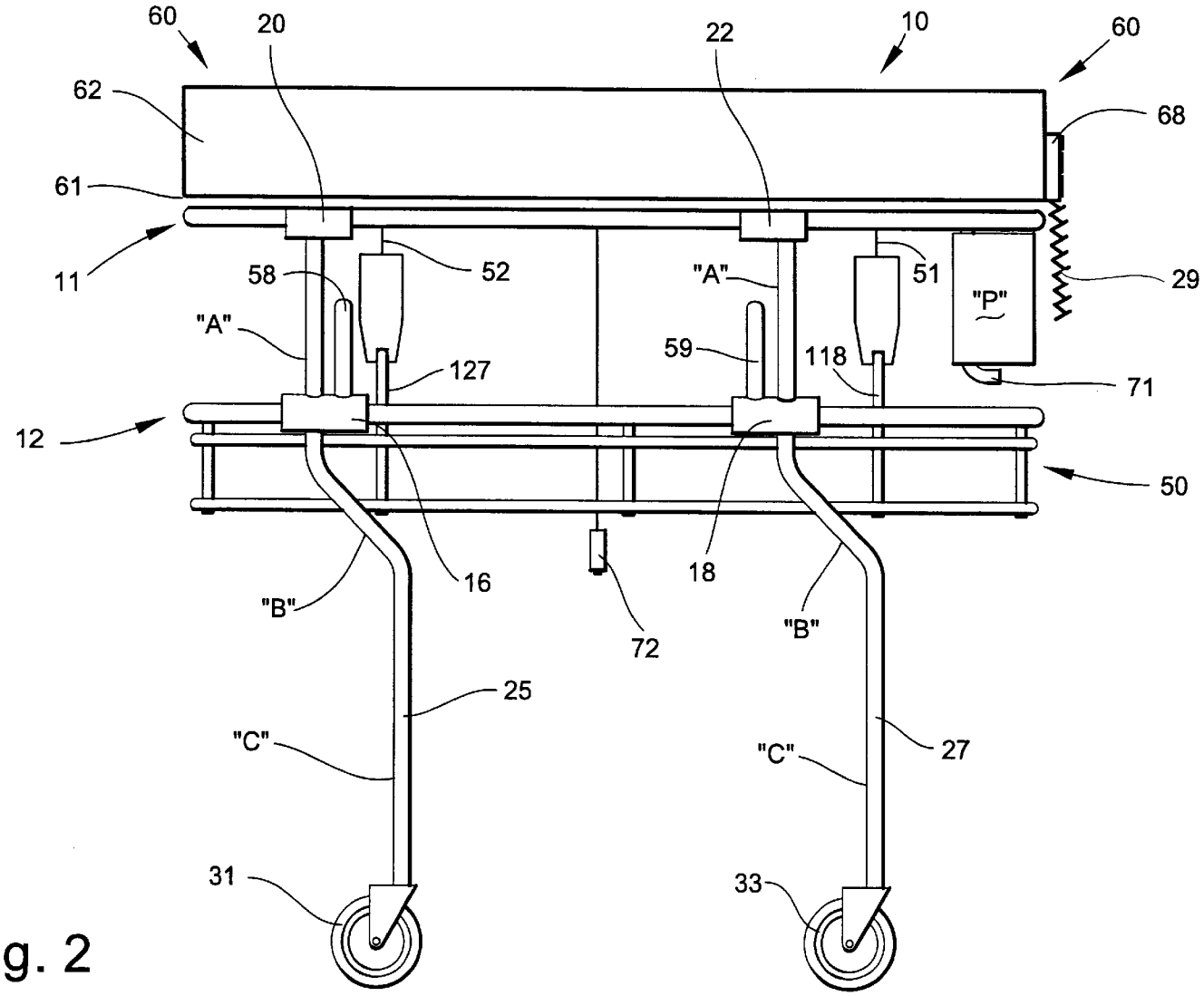
FIG. 2 is a side view of the transport apparatus with the legs in the closed position.
Figure 3:
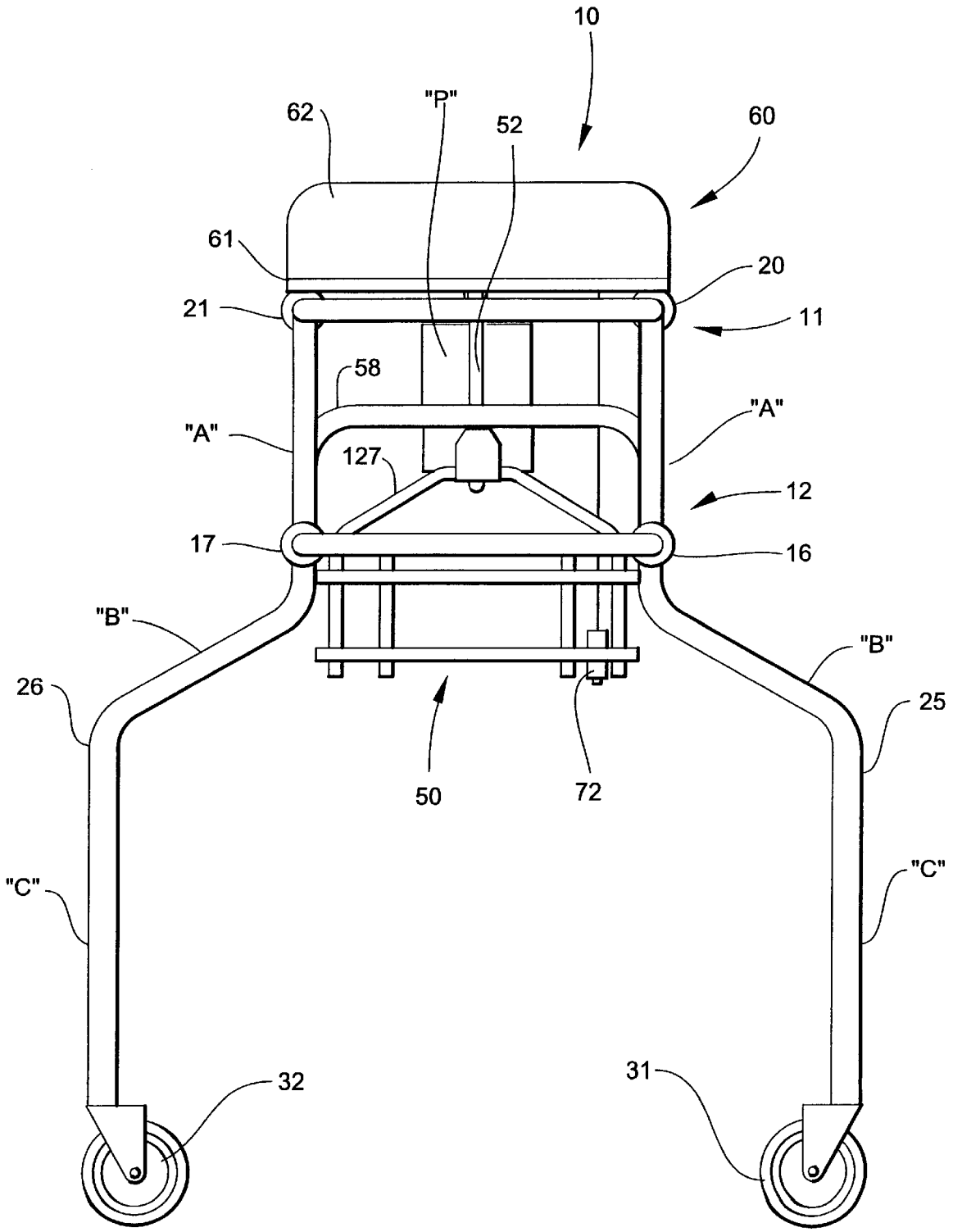
FIG. 3 is an end view of the transport apparatus with the legs in the open position.
Figure 4:
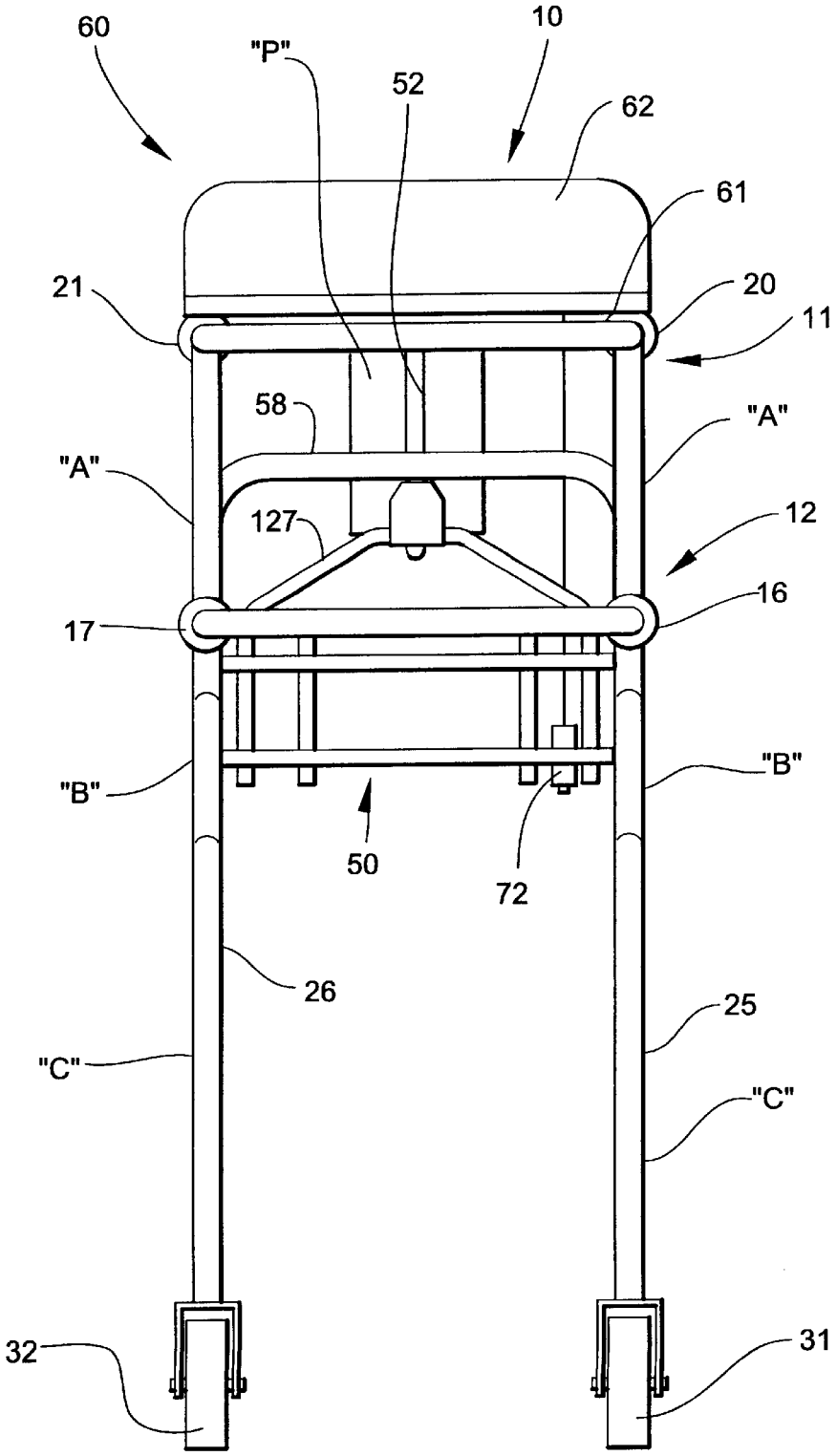
FIG. 4 is an end view of the transport apparatus with the legs in the closed position.

As best shown in FIGS. 2 and 3, each pivot leg 25–28 includes a vertical upper portion "A", an intermediate portion "B" integrally-formed at an angle to the upper portion "A", and a vertical lower portion "C" integrally-formed with the intermediate portion "B". The angle of the intermediate portion "B" relative to the upper portion "A" is preferably about 110 degrees. The lower portion "C" extends along an axis offset from and parallel to the upper portion "A", and is movable between open and closed positions to adjust the width of the apparatus 10. In the open position shown in FIG. 3, the distance between lower portions "C" of laterally adjacent legs 25–28 is increased in order to roll the apparatus 10 directly over the bed of the patient. In the closed position shown in FIGS. 2 and 4, the distance between lower portions "C" of laterally adjacent legs 25–28 is reduced.

A patient hoist frame 50 is suspended from the upper frame structure 11 by pairs of lift cables 51 and 52, and includes a removable fabric hammock 54 for carrying the patient in a generally supine position during transport. The hammock 54 includes a number of side edge grommets 55 which mate with hooks 56 extending downwardly from the hoist frame 50. The hoist frame 50 fits inside the perimeter of the lower frame structure 12 and is movable vertically by the cables 51 and 52 to lift and lower the patient. A pair of spaced, inverted U-shaped support braces 58 and 59 are attached to the lower frame structure 12 at collars 20–23 to increase the overall lateral stability of the apparatus 10 when lifting and transporting the patient from the bed.

An assembly housing 60 including a mounting deck 61 and cowling 62 is carried on the upper frame structure 12 for supporting and housing a linkage assembly 64, drive roller assembly 65, and control module 66 (See FIGS. 5–8). The linkage assembly 64 is operatively connected to the bent legs 25–28 for inducing simultaneous pivoting movement of the legs 25–28 between the open and closed positions. The drive roller assembly 65 controls operation of the lift cables 51 and 52 for lifting and lowering the patient hoist frame 50. The control module 66 is located at an end of the assembly housing 60 and contains the necessary circuitry for activating the linkage assembly, drive roller assembly, and other electrical components. A hand-held remote control unit 68 is preferably hard wired directly to the control module 66 and includes an elongate coiled cord 69 for allowing convenient, remote operation of the apparatus 10 by the caregiver. Alternatively, the remote control unit 68 may be completely detached from the apparatus 10. The linkage assembly 64, drive roller assembly 65, and control module 66 are described in further detail below.

In addition to the above, the apparatus 10 preferably includes one or more equipment support bars 71 (See FIG. 7) depending from the mounting deck 61 and having a slightly curved free end for supporting an IV pump or other medical device "D". Each support arm 71 is pivotable from a stowed position adjacent the underside of the deck 61 and an in-use position extending vertically downwardly from the deck 61. A patient call button 72 is also provided for allowing the patient to quickly and readily summon the caregiver.

The Linkage Assembly

Figure 5:
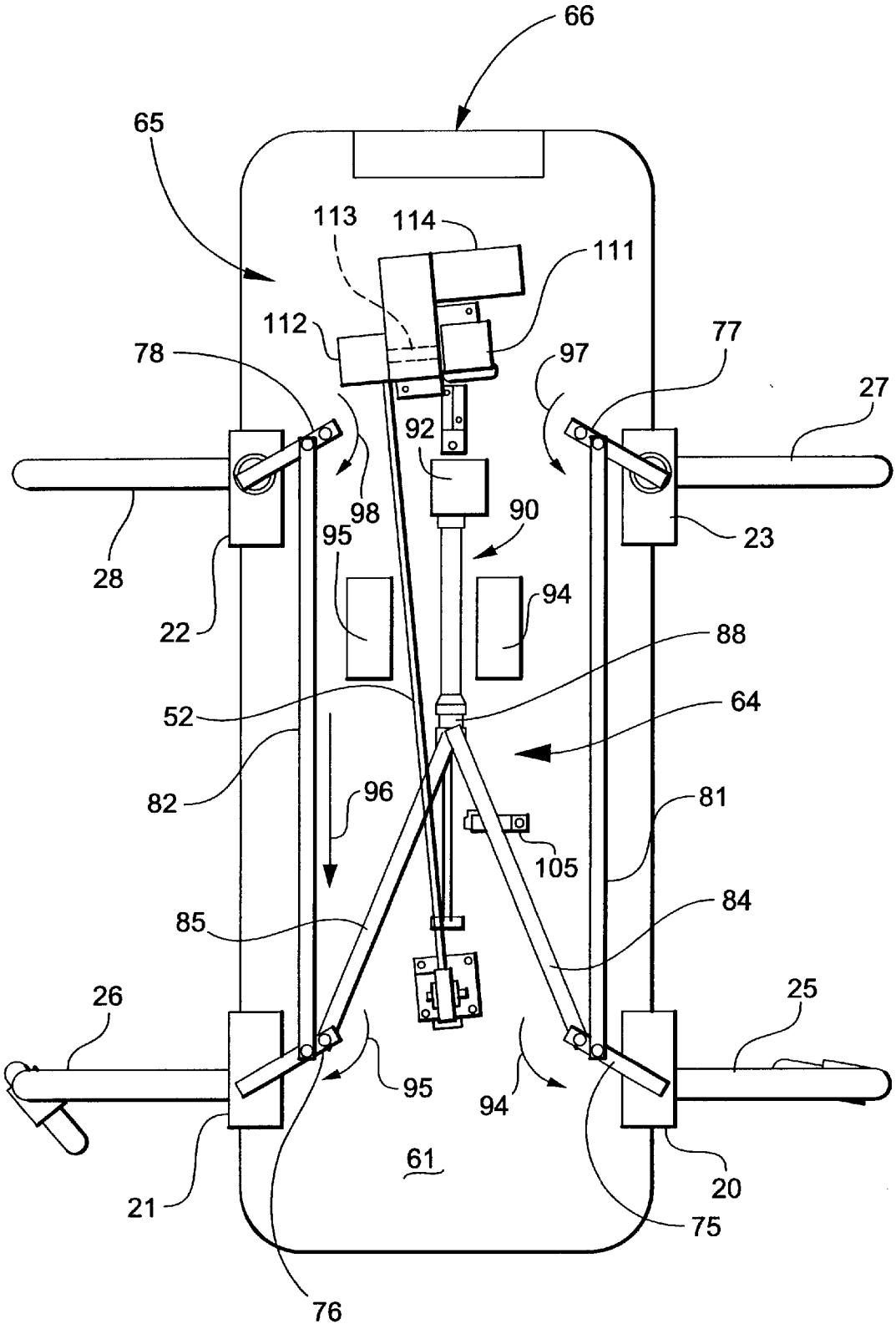
FIG. 5 is a top plan view of the transport apparatus with the cowling of the assembly housing removed, and showing the legs in the open position.
Figure 6:
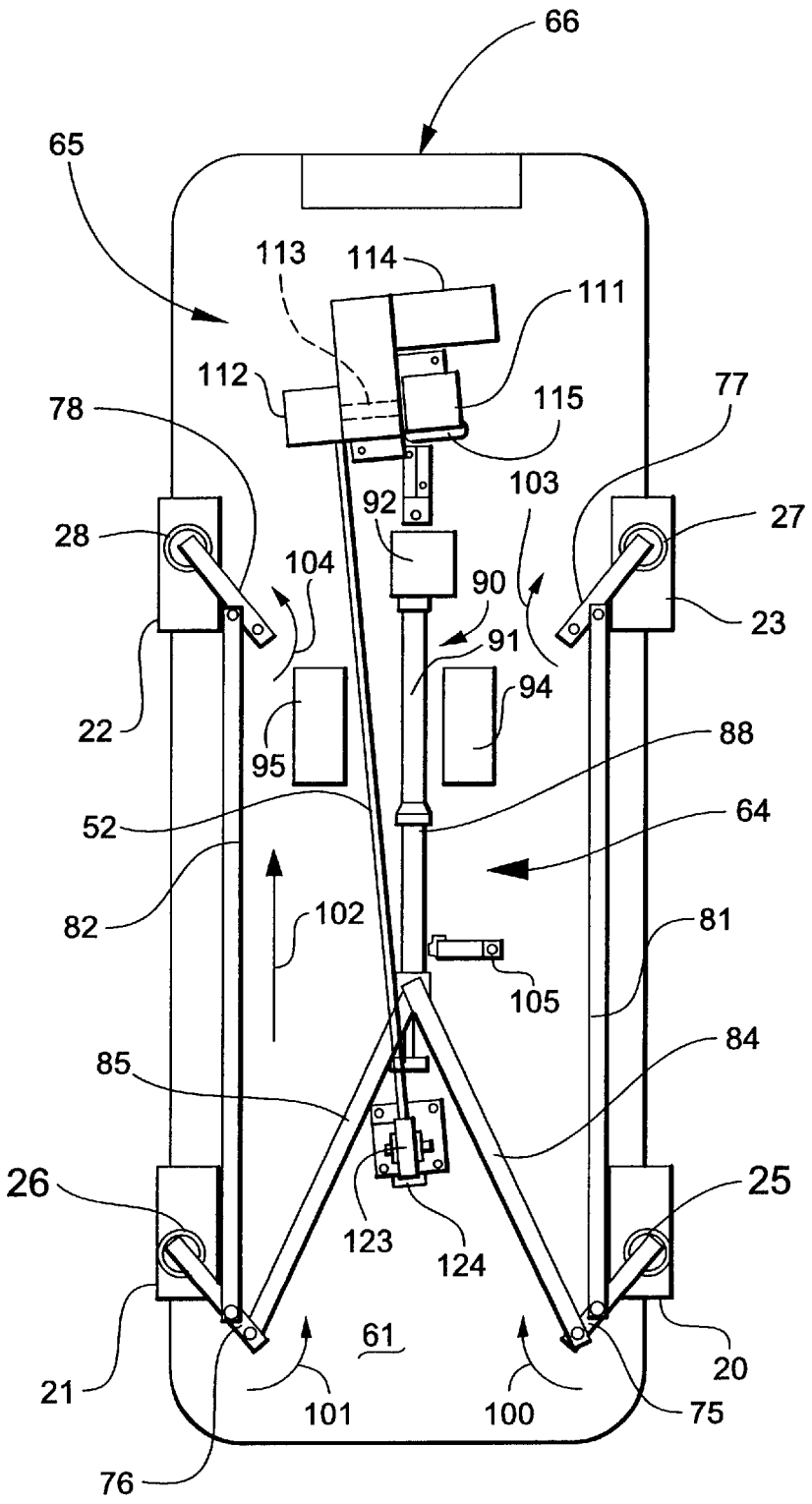
FIG. 6 is a top plan view of the transport apparatus with the cowling of the assembly housing removed, and showing the legs in the closed position.
Figure 7:
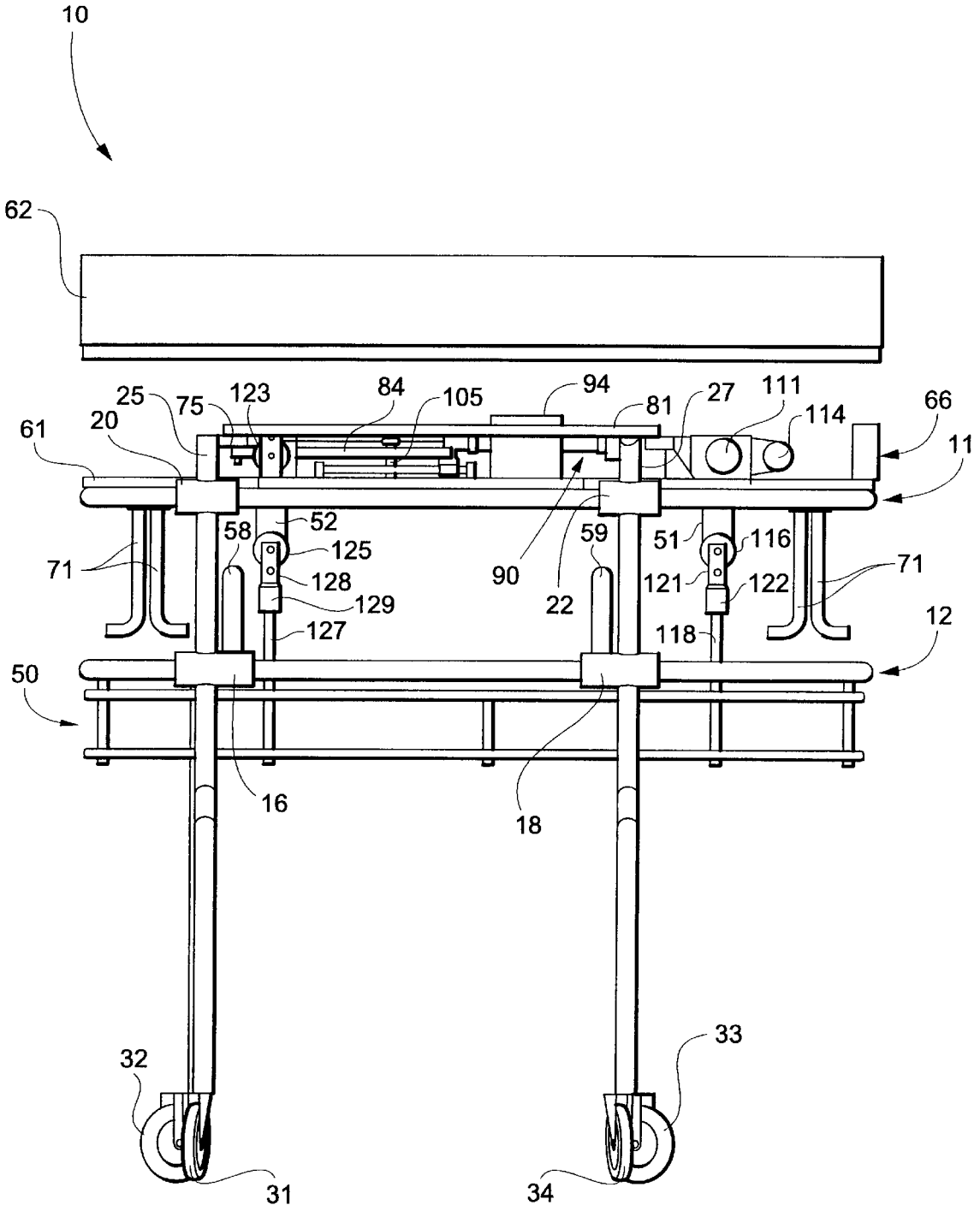
FIG. 7 is a side view of the transport apparatus with the cowling of the assembly housing lifted away from the mounting deck, and showing the legs in the open position.
Figure 8:
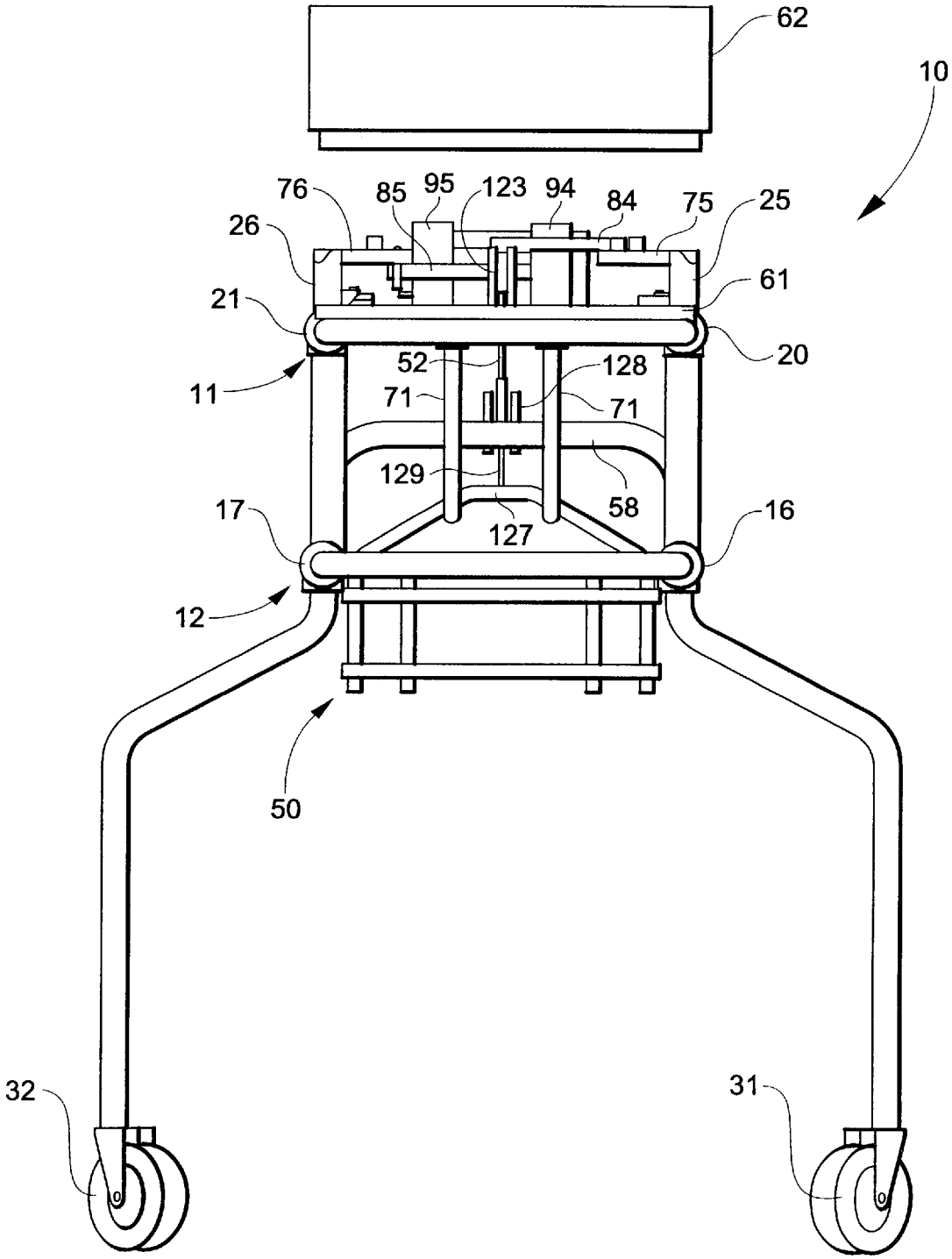
FIG. 8 is an end view of the transport apparatus with the cowling of the assembly housing lifted away from the mounting deck, and showing the legs in the open position.

As best shown in FIGS. 5 and 6, the linkage assembly 64 includes horizontal extension bars 75–78 fixed to respective top ends of legs 25–28. The extension bars 75–78 are linked in pairs by first and second longitudinal side bars 81 and 82. The side bar 81 is pivotably connected at its opposite ends to extension bars 75 and 77. The side bar 82 is pivotably connected to extension bars 76 and 78. First and second control bars 84 and 85 are pivotably connected to respective extension bars 75 and 76, and extend inwardly from the extension bars 75, 76 at an angle towards a center area of the mounting deck 61. The opposite ends of the control bars 84, 85 are pivotably connected to the drive shaft 88 of a linear actuator 90.

Referring to FIG. 6, the actuator drive shaft 88 is received within a hollow screw shaft 91, and is adapted for linear movement into and out of the screw shaft 91 to control actuation of the linkage assembly 64. The drive shaft 88 is activated by a DC motor 92 electrically connected to batteries 94 and 95 and the control module 66. The motor 92 actuates a worm gear which transmits power to an acme screw contained in the screw shaft 91. Rotation of the screw actuates the drive shaft 88. According to one embodiment, the actuator 90 is manufactured by Warner Electric and sold as "Electrak 150".

The actuator 90 cooperates with the above linking elements of the linkage assembly 64 to induce simultaneous pivoting movement of the legs 25–28 between the open position shown in FIG. 5 and the closed position shown in FIG. 6. Upon extension of the actuator drive shaft 88, the control bars 84 and 85 are pushed outwardly causing simultaneous rotation of extension bars 75 and 76 in directions 94 and 95, respectively, thus pivoting legs 25 and 26 inwardly towards the closed position. Rotation of extension bars 75 and 76 causes simultaneous movement of side bars 81 and 82 in direction 96. The side bars 81, 82 cause simultaneous rotation of the extension bars 77 and 78 in directions 97 and 98, respectively, which causes legs 27 and 28 to pivot inwardly towards the closed position.

Linear retraction of the actuator drive shaft 88 pulls the control bars 84 and 85 inwardly causing simultaneous rotation of extension bars 75 and 76 in directions 100 and 101, respectively, thus pivoting legs 25 and 26 outwardly towards the open position. Rotation of extension bars 75 and 76 causes simultaneous movement of side bars 81 and 82 in direction 102. The side bars 81 and 82 cause simultaneous rotation of the extension bars 77 and 78 in directions 103 and 104, respectively, which causes legs 27 and 28 to pivot outwardly towards the open position. Simultaneous movement of the legs 25–28 between the open position and the closed position takes between 10–30 seconds. Preferably, a limit switch 105 is mounted adjacent the actuator 90 for controlling the degree of extension and retraction of the drive shaft 88 in order to precisely locate the legs 25–28 in the open and closed positions.

The Drive Roller Assembly

Referring to FIGS. 5–8, the drive roller assembly 65 cooperates with lift cables 51 and 52 to control lifting and lowering of the patient hoist frame 50 relative to the frame structures 11 and 12. The assembly 65 includes spaced drive rollers 111 and 112 fixed to a single lateral drive shaft 113. The drive shaft 113 is actuated by an electric gear motor 114 operatively connected to the batteries 94 and 95 and the control module 66. Cable 51 is attached to the drive roller 111 and extends downwardly through an access 115 formed in the mounting deck 61 to a lift pulley 116. The cable 51 passes around the lift pulley 116 and back upwardly to the mounting deck 61 where it is permanently attached. The lift pulley 116 is interconnected to a lateral hoist bar 118 of the hoist frame 50 by bracket 121 and a load cell 122 for weighing the patient. The load cell 122 is electrically connected to a load cell indicator (not shown) which displays the weight of the patient when lifted for transport The second cable pair 52 is attached to the drive roller 112 and extends across the length of the mounting deck 61 to a guide pulley 123. The cable 52 passes over the guide pulley 123 and downwardly through a second access 124 in the mounting deck 61 to a second lift pulley 125. The cable 52 extends around the lift pulley 125 and back upwardly to the mounting deck 61 where it is permanently attached. The lift pulley 125 is interconnected to a second lateral hoist bar 127 by an identical bracket 128 and load cell 129. The load cell 129 is electrically connected to the load cell indicator which displays the weight of the patient when lifted for transport. Preferably, protective covers 130 (See FIGS. 1–4) are placed over the lift pulleys 116 and 125 to guard against injury to the fingers of the patient and caregiver.

When the gear motor 114 is activated causing positive rotation of the assembly drive shaft 113, the cables 51 and 52 collect on respective rollers 111 and 112 at the same rate causing the head and foot ends of the hoist frame 50 to elevate evenly. Counter rotation of the drive shaft 113 extends the cables 51 and 52 from the drive rollers 111 and 112 causing the hoist frame 50 to lower.

The Control Module

The control module 66 is located at an end of the assembly housing 60, and is electrically connected to batteries 94 and 95, the remote control unit 68, the actuator motor 92, and gear motor 114 of the drive roller assembly 65. The control module 66 has an exterior user control panel 131 (See FIG. 1) with push buttons for activating the actuator motor 92 and gear motor 114. The remote control unit 68 has corresponding buttons for opening and closing the legs 25–28 and lifting and lowering the patient hoist frame 50.

Sets of red, yellow, and green LED indicator lights (not shown) are electrically connected to the control module 66, and are located at respective corners of the cowling 62 to indicate whether the apparatus 10 is in a proper condition for safe transport of the patient. Illumination of the red indicator light indicates a potentially hazardous condition due to improper leg spacing or improper positioning of the patient hoist frame. Illumination of the green indicator light signals the caregiver to proceed with transport.

When voltage on the main battery 94 runs low, a low voltage indicator activates the yellow indicator light notifying the caregiver to switch to the backup battery 95. With the backup battery 95 in use, a further warning light indicates that the main battery 94 must be recharged soon. The patient call button 72 is always powered up off the main battery 94, and when activated, emits an audible alarm and causes the yellow indicator light to flash.

Operation of the Transport Apparatus

FIGS. 9–16 illustrate operation of the transport apparatus 10 for lifting the patient "P" from the bed "B" and then transporting the patient "P" to a location away from the bed "B". Although both a male and female caregiver "M" and "F" are shown, only a single caregiver is required to operate the apparatus 10.

Figure 9:
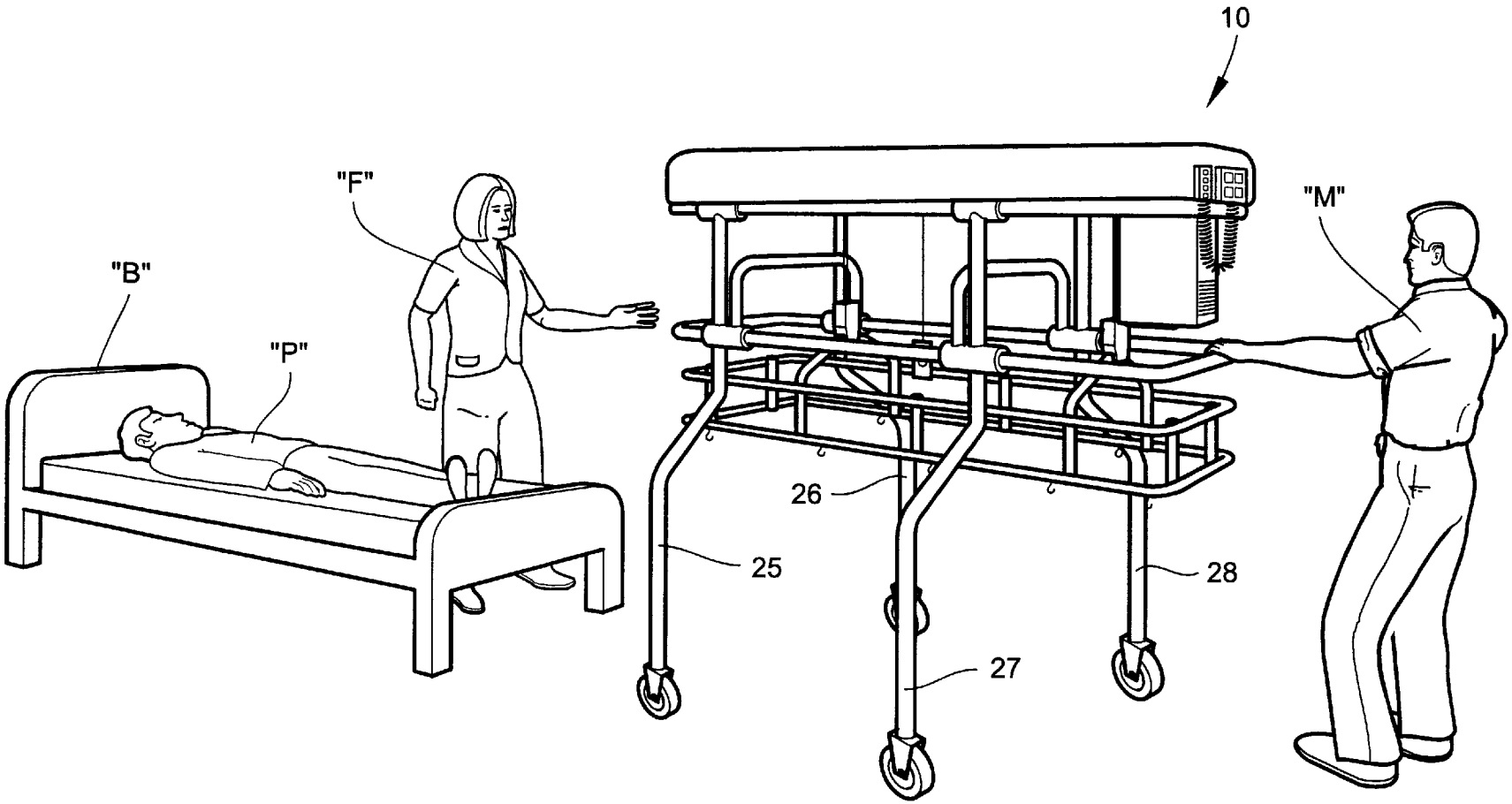
FIGS. 9–16 are views illustrating sequential operation of the apparatus for lifting the patient from the bed, and then transporting the patient from the bed to a remote location away from the bed.
Figure 10:
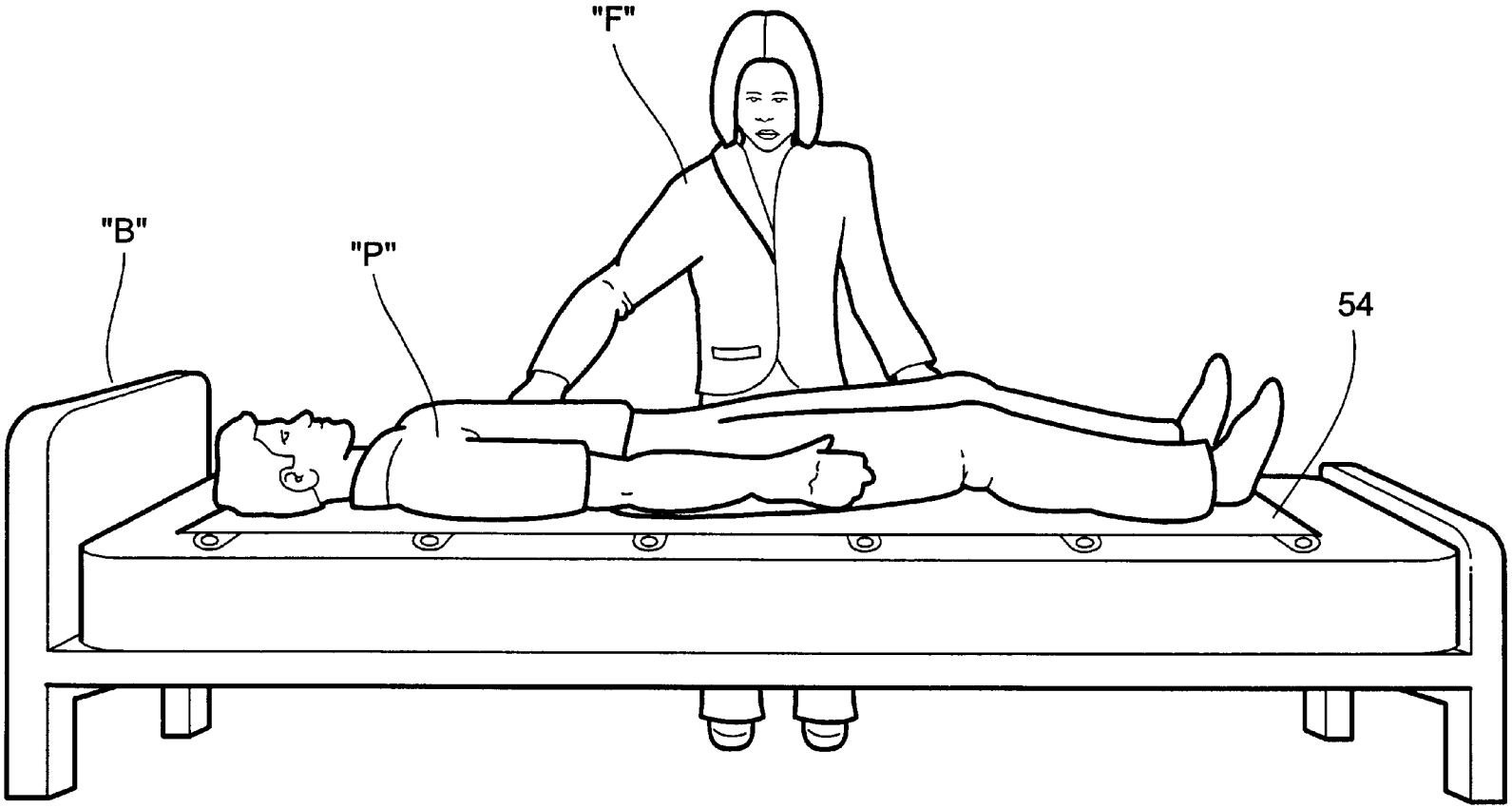
Figure 11:
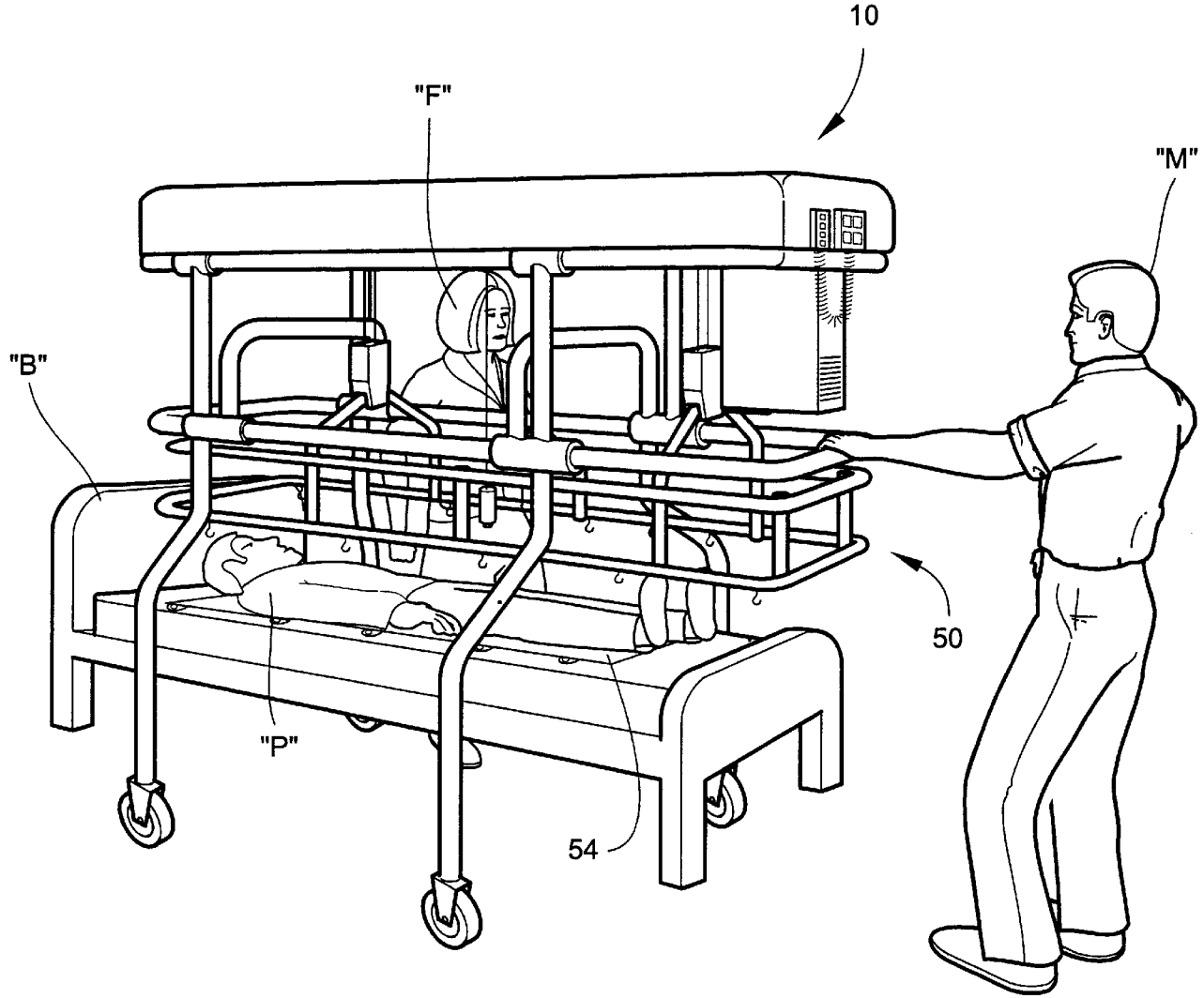
Figure 12:
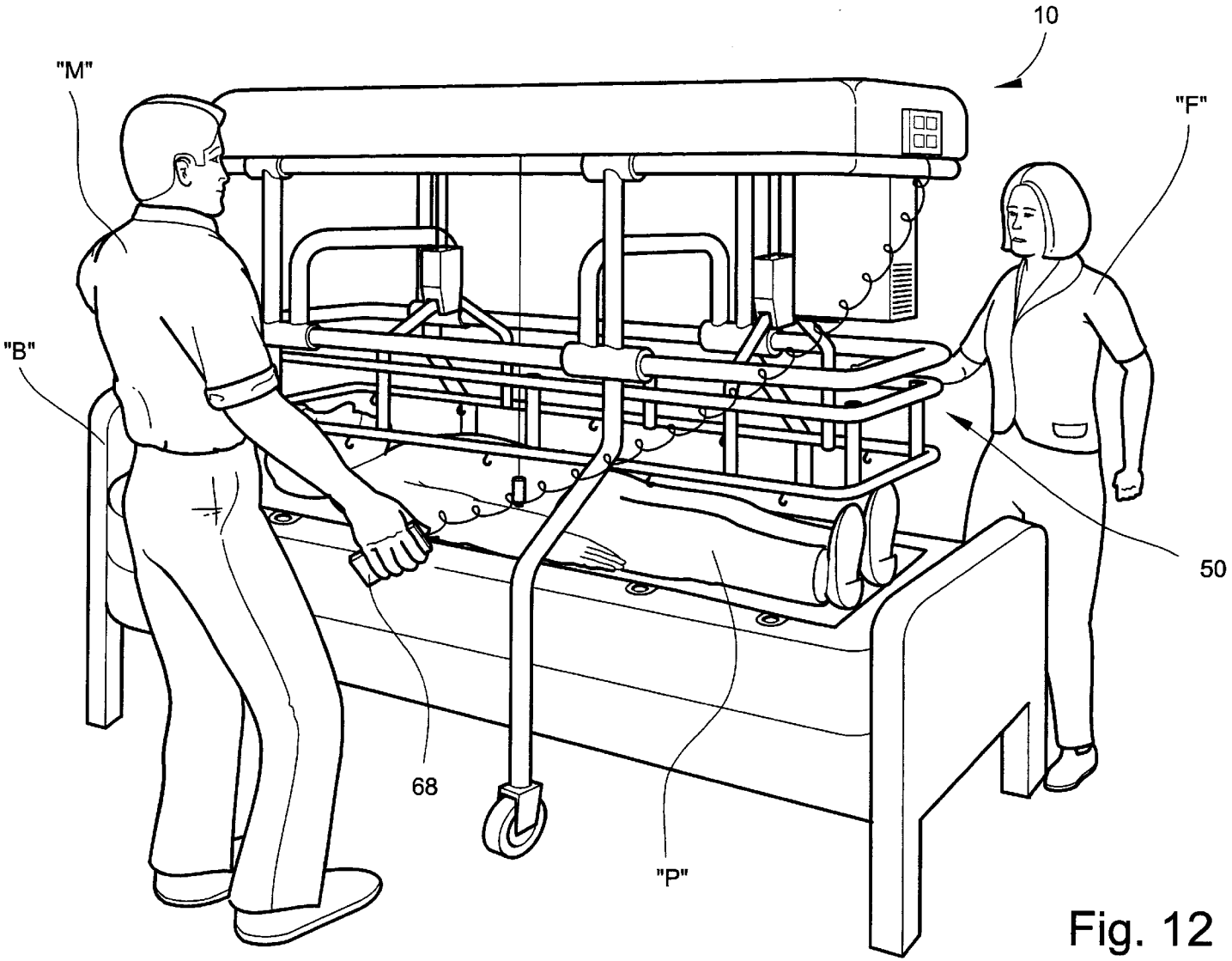
Figure 13:
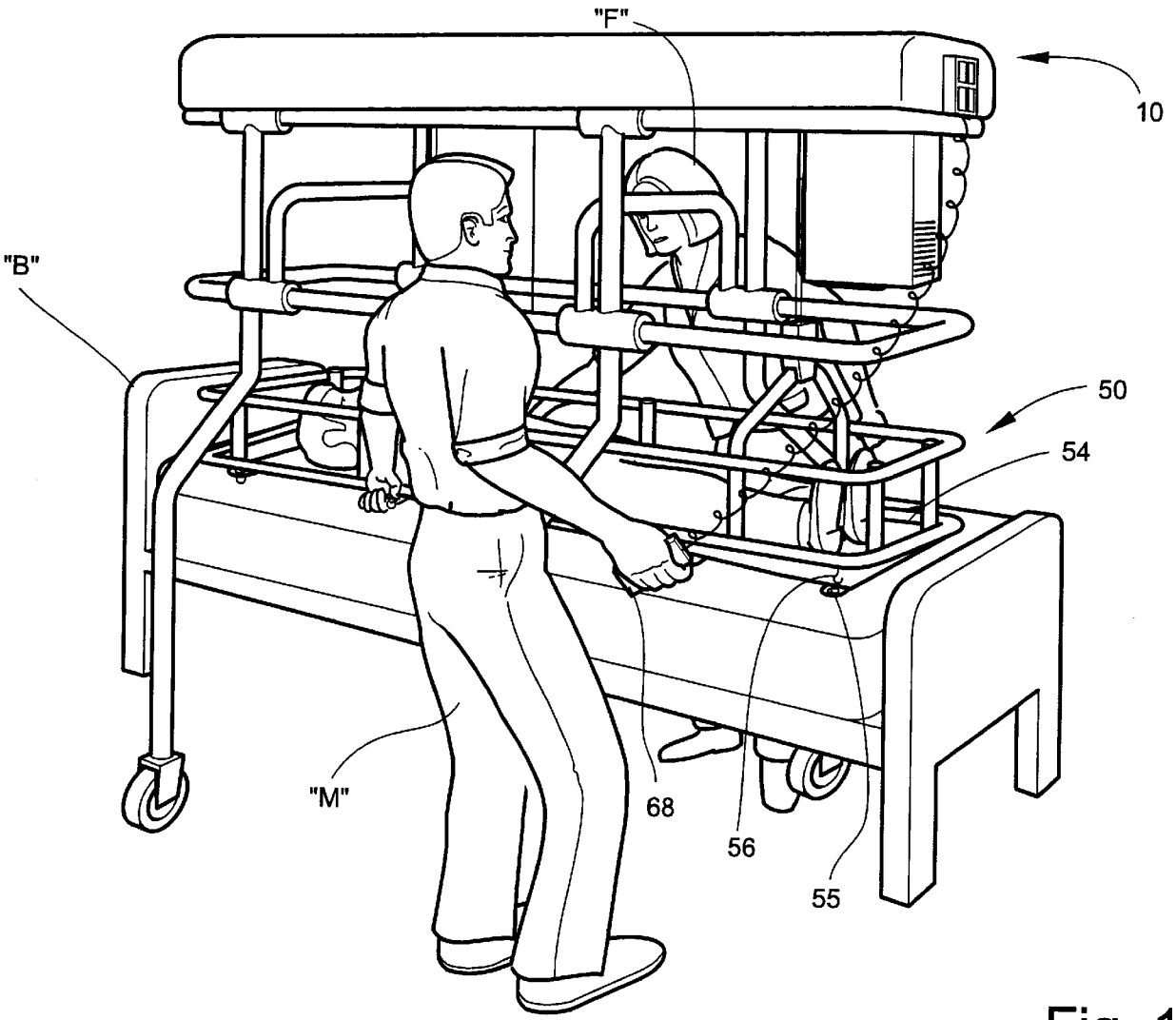
Figure 14:
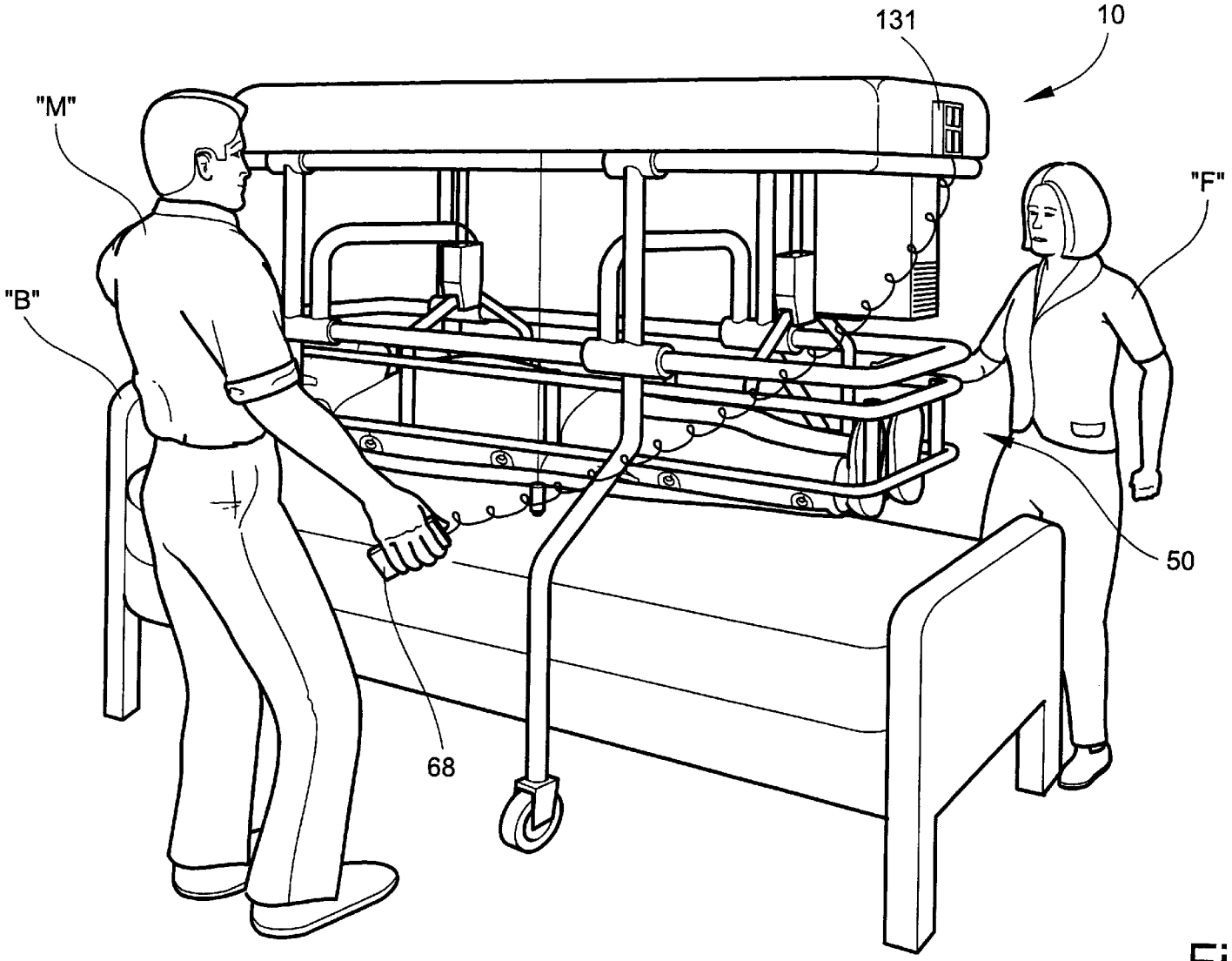
Figure 15:
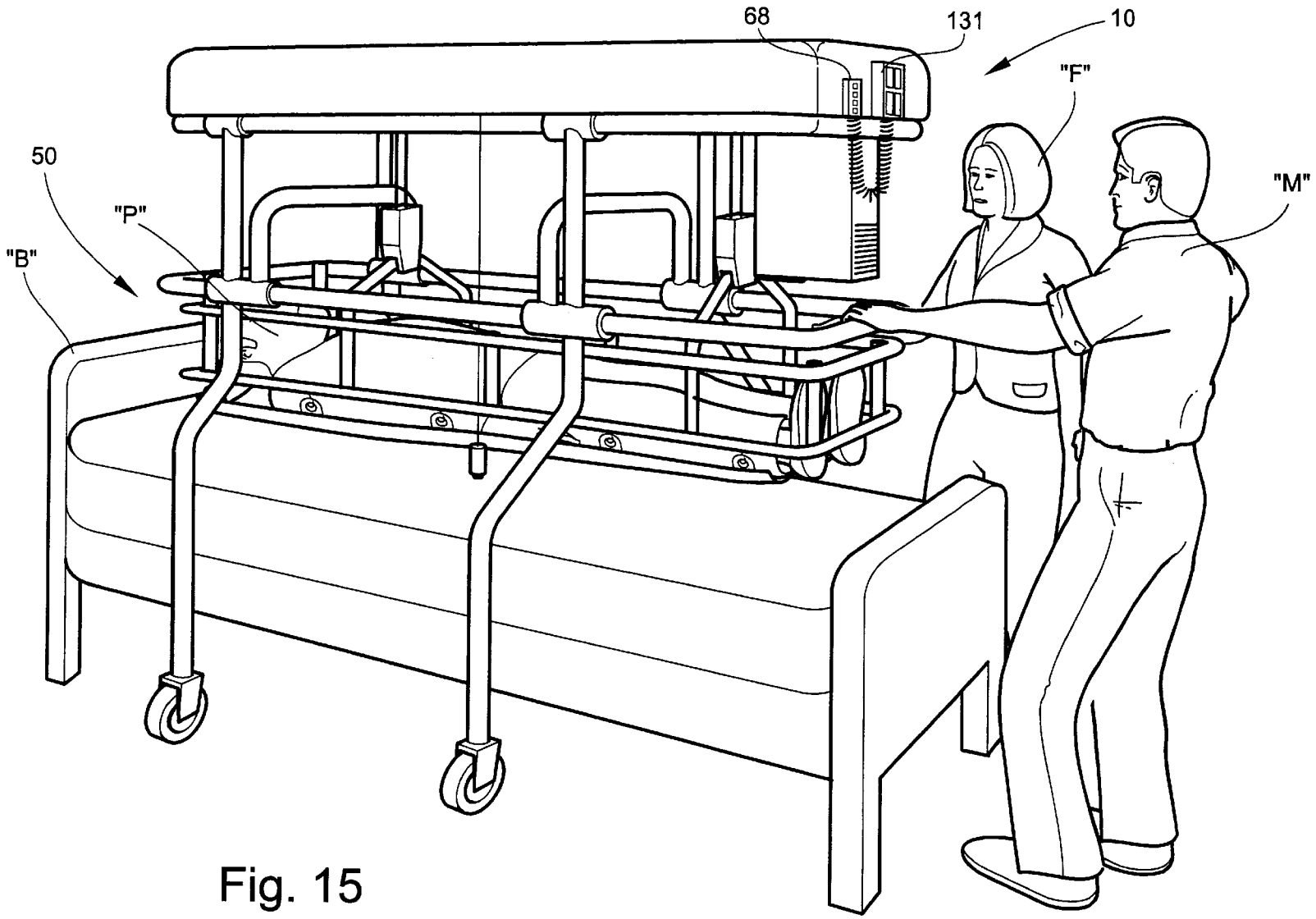
Figure 16:
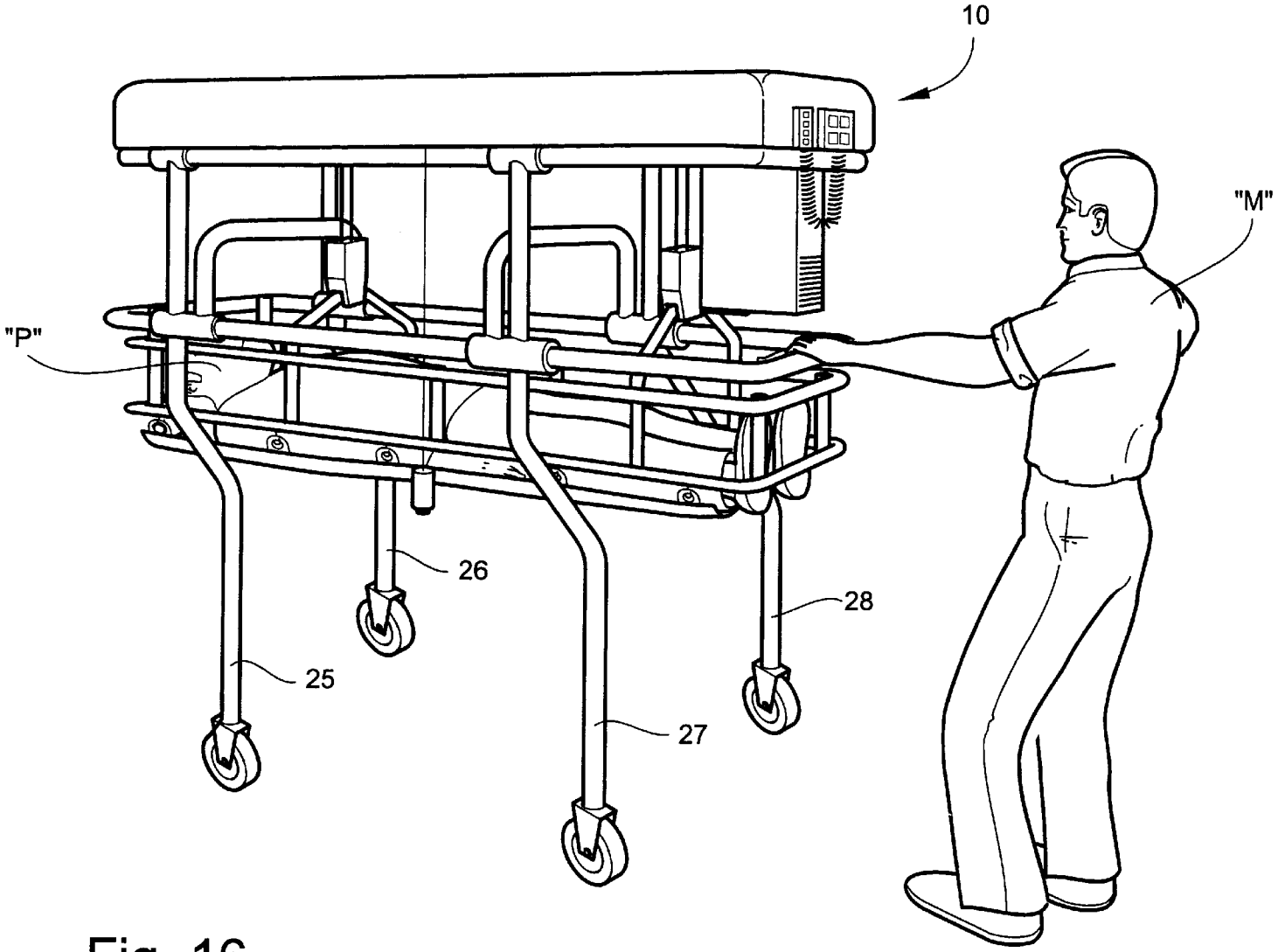

As shown in FIG. 9, the apparatus 10 is rolled towards the bed "B" of the patient "P" by the caregiver "M" and the legs 25–28 pivoted outwardly, as described above, to the open position. The second caregiver "F" rolls the patient "P" onto the fabric hammock 54, as shown in FIG. 10. With the hammock 54 in place, the first caregiver "M" rolls the apparatus 10 directly over the bed "B" to locate the hoist frame 50 above the patient "P", as shown in FIGS. 10 and 11. Using the hand-held remote control unit 68, the caregiver "M" lowers the hoist frame 50 downwardly to the bed "B", as shown in FIG. 12. The hoist frame 50 completely surrounds the patient "P". The hooks 56 are then attached to the grommets 55 of the hammock 54, as shown in FIG. 13, to secure the hammock 54 to the hoist frame 50. The hoist frame 50 is then raised, as previously described, and the patient "P" lifted upwardly from the bed "B" and into a position for transport, as shown in FIG. 14. The caregiver "M" replaces the remote control unit 68 adjacent the control module panel 131 and moves to the foot end of the apparatus 10 to pull the apparatus 10 away from the bed "B", as shown in FIG. 15. With the apparatus 10 safely away from the bed "B", the caregiver "M" presses the appropriate button on the control panel 131 to pivot the legs 25–28 into the closed position, as shown in FIG. 16. With the legs 25–28 closed, the apparatus 10 is conveniently maneuvered within the patient's room and through doorways and hallways. For added tip-resistance, the legs 25–28 may be widened for hallway transport. The patient "P" is returned to the bed "B" in the reverse manner.

The apparatus 10 is designed to lift a patient weighing as much as 625 lbs., although structural modifications may be made to accommodate a patient of any weight. The patient may be oriented as shown in the drawings, or alternatively, in a reverse orientation with his head at the opposite end of the apparatus 10.

A convertible patient transport apparatus is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A convertible patient transport apparatus, comprising:

(a) a frame assembly adapted for supporting a patient;

(b) a plurality of bent pivot legs attached to said frame assembly and mounted on respective wheels for rolling movement of said transport apparatus over a supporting surface, each of said pivot legs comprising a vertical upper portion, an intermediate portion formed at an angle to said upper portion, and a vertical lower portion formed with said intermediate portion;

(c) said frame assembly comprising an upper frame structure attached to said pivot legs, and a lower frame structure attached to said pivot legs and vertically spaced below said upper frame structure; and (d) actuating means for pivoting said legs between an open position, wherein a distance between the lower portions of laterally adjacent ones of said plurality of legs is increased, and a closed position, wherein the distance between the lower portions of laterally adjacent ones of said plurality of legs is reduced, such that:

i. in the open position, a width of said transport apparatus is expanded to move said frame assembly over a bed of the patient; and ii. in the closed position, the width of said transport apparatus is narrowed.

2. A patient transport apparatus according to claim 1, wherein the vertical lower portion of each leg extends along an axis offset from and parallel to the vertical upper portion.

3. A patient transport apparatus according to claim 1, and comprising a vertically disposed equipment support bar depending from said upper frame structure for holding medical equipment.

4. A patient transport apparatus according to claim 1, and comprising an inverted U-brace connected to said lower frame structure for laterally supporting said frame assembly.

5. A patient transport apparatus according to claim 1, and comprising a hoist frame suspended from said upper frame structure, and adapted for lifting and lowering the patient in a generally supine position.

6. A patient transport apparatus according to claim 5, wherein said hoist frame comprises spaced-apart lateral hoist bars located, respectively, near a foot end and a head end of said hoist frame.

7. A patient transport apparatus according to claim 5, and comprising a fabric hammock detachably secured to a bottom perimeter of said hoist frame.

8. A patient transport apparatus according to claim 6, and comprising lifting means for lifting and lowering said hoist frame relative to said frame assembly.

9. A patient transport apparatus according to claim 8, wherein said lifting means comprises a plurality of lift cables extending downwardly from the upper frame structure to the hoist frame.

10. A patient transport apparatus according to claim 9, wherein said upper frame structure comprises a mounting deck, and wherein said lifting means further comprises a drive roller assembly mounted on said deck and attached to said lift cables.

11. A patient transport apparatus according to claim 10, and comprising a motor operatively connected to said drive roller assembly and mounted on said deck for rotating said drive roller assembly, said drive roller assembly and cables cooperating to lift and lower said hoist frame.

12. A patient transport apparatus according to claim 10, and comprising a vertically disposed guide pulley rotatably mounted on said mounting deck a spaced-apart distance from said drive roller assembly and above one of said hoist bars for guiding at least one of said lift cables from said drive roller assembly across said deck and downwardly towards said patient hoist frame.

13. A patient transport apparatus according to claim 1, wherein said actuating means comprises an interconnected linkage assembly operatively connected to respective top ends of said pivot legs for inducing simultaneous pivoting movement of said legs between the open and closed positions.

14. A patient transport apparatus according to claim 13, wherein said linkage assembly includes an extension bar attached to each of said pivot legs.

15. A patient transport apparatus according to claim 14, wherein said linkage assembly includes first and second longitudinal side bars extending along respective opposing sides of said frame assembly and interconnecting said extension bars of longitudinally adjacent ones of said plurality of pivot legs.

16. A patient transport apparatus according to claim 15, wherein said linkage assembly includes first and second control bars pivotably connected to respective extension bars of two laterally adjacent ones of said plurality of pivot legs, and having opposite adjoining ends pivotably connected together in a central area of said frame assembly.

17. A patient transport apparatus according to claim 16, wherein said actuating means further comprises a linear actuator connected to the adjoining ends of said first and second control bars, and operable such that upon extension and retraction of said actuator, said control bars cooperate to move each of said interconnected extension bars and side bars, thereby inducing simultaneous pivoting movement of each of said bent legs between the open position and the closed position.

18. A patient transport apparatus according to claim 17, and comprising a hand-held remote control operatively connected to said linear actuator for controlling movement of said legs between the open and closed positions.

19. A patient transport apparatus according to claim 1, and comprising a call button for being activated by the patient to summon the assistance of a caregiver.

20. A method of transporting a patient from a bed to a remote location away from the bed, comprising the steps of:

(a) providing a patient transport apparatus including a plurality of bent legs, and a frame assembly having an upper frame structure and a lower frame structure, the lower frame structure being attached to the bent legs and vertically spaced below the upper frame structure;

(b) pivoting the plurality of bent legs of the patient transport apparatus to an open position wherein a width of the transport apparatus is expanded to move the frame assembly of the transport apparatus over the bed of a patient;

(c) securing the patient to a hoist frame suspended from the upper frame structure of the frame assembly;

(d) lifting the hoist frame to remove the patient from the bed;

(e) with the patient supported above the bed, moving the transport apparatus away from the bed; and (f) pivoting the bent legs from the open position to a closed position wherein the width of the transport apparatus is narrowed for movement of the transport apparatus to a remote location.

* * * * *